US010215191B2

(12) United States Patent
Omori et al.

(10) Patent No.: US 10,215,191 B2
(45) Date of Patent: Feb. 26, 2019

(54) VACUUM PUMP CONTROL DEVICE AND VACUUM PUMP

(71) Applicant: Edwards Japan Limited, Yachiyo-shi (JP)

(72) Inventors: Hideki Omori, Chiba (JP); Takashi Kabasawa, Chiba (JP)

(73) Assignee: Edwards Japan Limited, Yachiyo-Shi (JP)

( * ) Notice: Subject to any disclaimer, the term of this patent is extended or adjusted under 35 U.S.C. 154(b) by 150 days.

(21) Appl. No.: 15/473,022

(22) Filed: Mar. 29, 2017

(65) Prior Publication Data

US 2017/0298922 A1 Oct. 19, 2017

Related U.S. Application Data

(63) Continuation of application No. 13/877,274, filed as application No. PCT/JP2011/067283 on Jul. 28, 2011.

(30) Foreign Application Priority Data

Oct. 7, 2010 (JP) ..... 2010-227881

(51) Int. Cl.
*F04D 29/58* (2006.01)
*F04B 37/08* (2006.01)
(Continued)

(52) U.S. Cl.
CPC ..... *F04D 29/5813* (2013.01); *F04B 37/08* (2013.01); *F04B 37/085* (2013.01);
(Continued)

(58) Field of Classification Search
CPC ..... F04B 49/00; F04B 37/08; F04B 37/085; F04B 37/14; F04B 35/045; F04B 39/06;
(Continued)

(56) References Cited

U.S. PATENT DOCUMENTS

2010/0127818 A1 5/2010 Ishikawa et al.
2010/0247350 A1* 9/2010 Nagano ..... F04B 35/045 417/410.1
2013/0209272 A1 8/2013 Omori et al.

FOREIGN PATENT DOCUMENTS

CN 1842655 A 10/2006
EP 1898098 A2 3/2008
(Continued)

OTHER PUBLICATIONS

Prosecution History from U.S. Appl. No. 13/877,274, dated May 22, 2015 through Feb. 1, 2017, 61 pp.
(Continued)

*Primary Examiner* — Kenneth J Hansen
(74) *Attorney, Agent, or Firm* — Shumaker & Sieffert, P.A.

(57) ABSTRACT

An object of the present invention is to improve, using a simple configuration, heat dissipation of a regenerative resistor that is disposed in a vacuum pump control device (controller) connected to a vacuum pump. The regenerative resistor disposed in the vacuum pump control device is stored in an aluminum die-cast casing. More concretely, a housing of the vacuum pump control device is prepared by aluminum die casting (metal mold casting). A regenerative resistor storing portion (aluminum die-cast casing) provided with a hollow portion is provided on a top panel of the aluminum die cast, the hollow portion being designed to have a size accommodating the entire regenerative resistor. The regenerative resistor is fitted into the hollow portion, and an opening section of the hollow portion is sealed with an aluminum sheet of the same material as that of the casing. In this manner, the regenerative resistor can removably be stored in the aluminum die-cast casing.

26 Claims, 9 Drawing Sheets

(51) Int. Cl.

| | |
|---|---|
| ***F04B 37/14*** | (2006.01) |
| ***F04D 19/04*** | (2006.01) |
| ***F04D 25/06*** | (2006.01) |

(52) U.S. Cl.
CPC ..... *F04B 37/14* (2013.01); *F04D 19/042* (2013.01); *F04D 25/068* (2013.01)

(58) Field of Classification Search
CPC ..... F04B 53/08; F04D 19/042; F04D 25/068; F04D 29/5813
See application file for complete search history.

(56) References Cited

FOREIGN PATENT DOCUMENTS

| | | | |
|---|---|---|---|
| JP | 01100401 | U | 7/1989 |
| JP | 09028094 | A | 1/1997 |
| JP | 2002180990 | A | 6/2002 |
| JP | 2002285993 | A | 10/2002 |
| JP | 2006073658 | A | 3/2006 |
| JP | 2007255223 | A | 10/2007 |
| JP | 2008230751 | A | 10/2008 |
| WO | 2010016176 | A1 | 1/2012 |

OTHER PUBLICATIONS

International Search Report and Written Opinion, and translation thereof, from International Application No. PCT/JP2011/067283, dated Oct. 25, 2011, 12 pp.
International Preliminary Report on Patentability, and translation thereof, from International Application No. PCT/JP2011/067283, dated May 8, 2013, 9 pp.
Declaration Under 37 C.F.R. 1.132, by Yoshinobu Ohtachi, dated Jun. 27, 2017, 2 pp.
Extended Search Report from counterpart European Application No. 11830428.6, dated Jan. 2, 2018, 8 pp.

* cited by examiner

VACUUM PUMP CONTROL DEVICE AND VACUUM PUMP

This application is a continuation of U.S. application Ser. No. 13/877,274, filed Apr. 1, 2013, which is a U.S. national phase application under 37 U.S.C. § 371 of international application number PCT/JP2011/067283 filed on Jul. 28, 2011, which claims priority to JP application number 2010-227881 filed Oct. 7, 2010. The entire contents of each of U.S. application Ser. No. 13/877,274, international application number PCT/JP2011/067283 and JP application number 2010-227881 are incorporated herein by reference.

BACKGROUND OF THE INVENTION

Field of the Invention

The present invention relates to a vacuum pump control device and a vacuum pump, and particularly relates to a vacuum pump control device capable of efficiently cooling a regenerative resistor thereof in order to, for example, prevent a housing of the vacuum pump control device from overheating, and to a vacuum pump having this vacuum pump control device.

Description of the Related Art

A vacuum pump control device (controller) that controls a motor for rotating a rotor is electrically connected to a vacuum pump such as a turbo-molecular pump that performs an exhaust process by rotating the rotor in a casing with inlet and outlet ports at high speeds.

In this type of rotary machine using a motor, electric energy (regenerative energy) is generated when the motor is rotated upon deceleration. The regenerative energy increases a DC voltage in a motor driver circuit controlling the motor, which might lead to damage to an element inside the circuit. The regenerative energy, therefore, needs to be processed so that the circuit element is not damaged. One of the methods for processing regenerative energy is the use of a regenerative resistor. The regenerative resistor converts regenerative energy into thermal energy and consumes this energy. It is, therefore, inevitable that the regenerative resistor itself generates heat.

For the purpose of cooling the regenerative resistor, the regenerative resistor is attached in contact with a side surface (wall surface) and the like of a housing that encloses elements configuring the vacuum pump control device. Therefore, the heat is generated from the section in the housing of the vacuum pump control device to which the regenerative resistor is attached, and, consequently, the housing of the vacuum pump control device is heated. The vacuum pump control device eventually becomes too hot to touch.

The tolerance of the regenerative resistor is approximately 300° C., and the regenerative resistor needs to be cooled constantly so that the regenerative resistor can keep a temperature significantly lower than the tolerance from the standpoint of safety and reliability.

The heat that is generated in the vacuum pump control device (i.e., the heat generated from the regenerative resistor, etc.) is transmitted to the vacuum pump through the connection portion between the vacuum pump control device and the vacuum pump. As a result, the vacuum pump is heated to a high temperature, harming a vacuum device connected to the vacuum pump.

The vacuum device is now described.

Examples of a vacuum device that keeps a vacuum therein by performing an exhaust process using a vacuum pump include a semiconductor manufacturing device, an electron microscope device, a surface analysis device, and a microfabricated device. In such a vacuum device, the error between the measurement accuracy and the machining accuracy becomes significant under the influence of the radiated heat of the vacuum pump described above, causing a great deal of problem in the measuring/machining steps.

For this reason, the regenerative resistor disposed in the vacuum pump control device needs to be constantly cooled in order to realize more precise machining or measurement of higher precision in the vacuum device.

FIG. 8A is a cross-sectional diagram showing an example of a schematic configuration of a conventional vacuum pump control device 2000.

In this conventional vacuum pump control device 2000, for example, a heat sink (a radiator, a radiator plate), not shown, is prepared separately and attached to a heat generating machine/electronic component (attached near or on a wall surface thereof), and the temperature of the vacuum pump control device 2000 is reduced by releasing heat using the heat sink. Further, an air-cooling fan (cooling fan) 50 and the like are installed as shown in FIG. 8A, to improve the cooling capacity of the device by forcibly moving more air therein.

More specifically, a regenerative resistor 200 is normally mounted on a motor control board (i.e., a board on which a circuit for controlling a motor of a vacuum pump is mounted) 300 along with other elements (a CPU, a transistor, etc.) that also function to control the motor, as shown in FIG. 8B. However, mounting the regenerative resistor 200 and the other elements on the same control board 300 increases the temperatures of both the regenerative resistor 200 and the other elements due to the heat generated by the regenerative resistor 200.

When directly cooling the control board 300 by bringing a cooling medium close to the control board 300 on which the regenerative resistor 200 in order to prevent such temperature increase (in order to cool the regenerative resistor, etc.), dew condensation forms on the cooled part, causing serious damage to the other elements.

The formation of dew condensation here is a phenomenon in which water vapor in the air condenses and forms liquid droplets on the cooled surface of the cooled part (i.e., a surface of, or the inside of, a solid substance) when the cooled part (cooled surface) is cooled until the dew point or below (i.e., the temperature at which the relative temperature becomes 100%). When such dew condensation occurs in the control board 300, there is a possibility that a malfunction occurs in the control circuit.

For these reasons, the conventional vacuum pump control device adopts a method for cooling only the regenerative resistor 200 by removing the regenerative resistor 200 from the control board 300, bringing the regenerative resistor 200 directly into close contact with a wall surface of a housing of the vacuum pump control device 2000, and cooling the wall surface with the cooling fan 50 as shown in FIG. 8A.

As an example of bringing an electric element or resistor into close contact with a wall surface of a housing to cool the electric element or resistor, Japanese Patent Application Publication No. 2006-73658 proposes a technology for cooling a heat-generating element.

Specifically, Japanese Patent Application Publication No. 2006-73658 discloses a technology for efficiently releasing heat generated in the electric element, through an electrode and a side surface portion of an electric element storing container by joining the electric element to the side surface portion of the electric element storing container via the electrode.

However, it is difficult to separately provide a heat sink in the conventional device, because the vacuum pump is small relative to the power of the motor or because the surrounding environment needs to be kept clean, in connection with the steps carried out in the vacuum device. In most cases, a fan cannot be installed, in light of noise and reliability.

In addition, when providing a heat sink or a fan separately, a dedicated cooling pipe or cooling system are required, which leads to a cost increase, and moreover a space for disposing these components needs to be secured.

When, on the other hand, removing only the regenerative resistor from the control board and bringing the regenerative resistor directly into close contact with the wall surface of the housing of the vacuum pump control device to cool the wall surface, the temperature of the wall surface of the housing with which the regenerative resistor is brought into close contact, propagates to the whole surfaces of the housing. Therefore, the housing itself becomes too hot to touch, causing dangerous conditions.

SUMMARY OF THE INVENTION

An object of the present invention, therefore, is to provide a vacuum pump control device capable of improving heat dissipation of a regenerative resistor thereof by using a simple configuration, and a vacuum pump having this vacuum pump control device.

An invention according to claim 1 provides a vacuum pump control device for controlling a vacuum pump main body, the vacuum pump control device including: a housing in which a control circuit for controlling the vacuum pump main body is disposed; a regenerative resistor storing portion that is provided in the housing, and has a hollow portion into which is inserted a regenerative resistor consuming regenerative energy, and a regenerative resistor fixture for fixing the regenerative resistor; and a cooling mechanism for cooling the regenerative resistor storing portion.

An invention according to claim 2 provides the vacuum pump control device described in claim 1, wherein the regenerative resistor storing portion is produced by a casting process.

An invention according to claim 3 provides the vacuum pump control device described in claim 1 or 2, wherein the regenerative resistor storing portion is positioned away from a side surface sandwiched between a surface of the housing on which the control circuit is disposed and a surface of the housing on which the regenerative resistor storing portion is provided.

An invention described in claim 4 provides the vacuum pump control device described in at least one of claims 1 to 3, wherein the regenerative resistor is stored in a regenerative resistor storing tool having an outer circumferential surface fitted into an inner circumference of the hollow portion, and is then inserted into the hollow portion.

An invention according to claim 5 provides the vacuum pump control device described in claim 4, wherein between the inner circumference of the hollow portion and the regenerative resistor storing tool inserted thereto, a clearance is provided in advance for accommodating the regenerative resistor that expands when the regenerative resistor generates heat.

An invention according to claim 6 provides a vacuum pump including: the vacuum pump main body including a gas transfer mechanism for transferring a gas from an inlet port to an outlet port; and the vacuum pump control device described in at least one of claims 1 to 5.

The present invention can provide a vacuum pump control device capable of improving heat dissipation of a regenerative resistor thereof by using a simple configuration, and a vacuum pump having this vacuum pump control device.

DESCRIPTION OF THE PREFERRED EMBODIMENTS

(i) Brief Summary of an Embodiment

In an embodiment of the present invention, a regenerative resistor is provided in a vacuum pump control device (controller) for controlling a motor rotating a rotor of a vacuum pump and is stored in an aluminum diecast casing.

More concretely, a housing of the vacuum pump control device is produced by aluminum die casting (metal mold casting), and then a regenerative resistor storing portion that is provided with a hollow portion of a size accommodating the entire regenerative resistor is installed in a part of the aluminum die cast (a top panel, in the present embodiment, i.e., an upper lid of the vacuum pump control device). Hereinafter, the regenerative resistor storing portion with the hollow portion, which is provided in the aluminum die-cast top panel of the housing of the vacuum pump control device, is referred to as "casing" for accommodating the regenerative resistor, the casing being produced by aluminum die casting.

The regenerative resistor is removably stored in the hollow portion, by fitting the regenerative resistor in the hollow portion and sealing an opening section of the hollow portion with a bolt and an aluminum sheet (a regenerative resistor fixture) made of the same material as the casing.

(ii) Detail of the Embodiment

A preferred embodiment of the present invention is described hereinafter in detail with reference to FIGS. 1 to 7.

The present embodiment is described using a turbomolecular pump as an example of the vacuum pump. In the embodiment, according to the present invention, a vacuum pump control device 20 for controlling a turbomolecular pump main body molecular pump main body 11 is attached to the via pump fixing legs turbo-. In other words, the turbo-molecular pump main body 1 is integrated with the vacuum pump control device 20. (Vacuum pump main body) The turbo-molecular pump main body 1 according to the embodiment of the present invention is described first.

Figure 1:
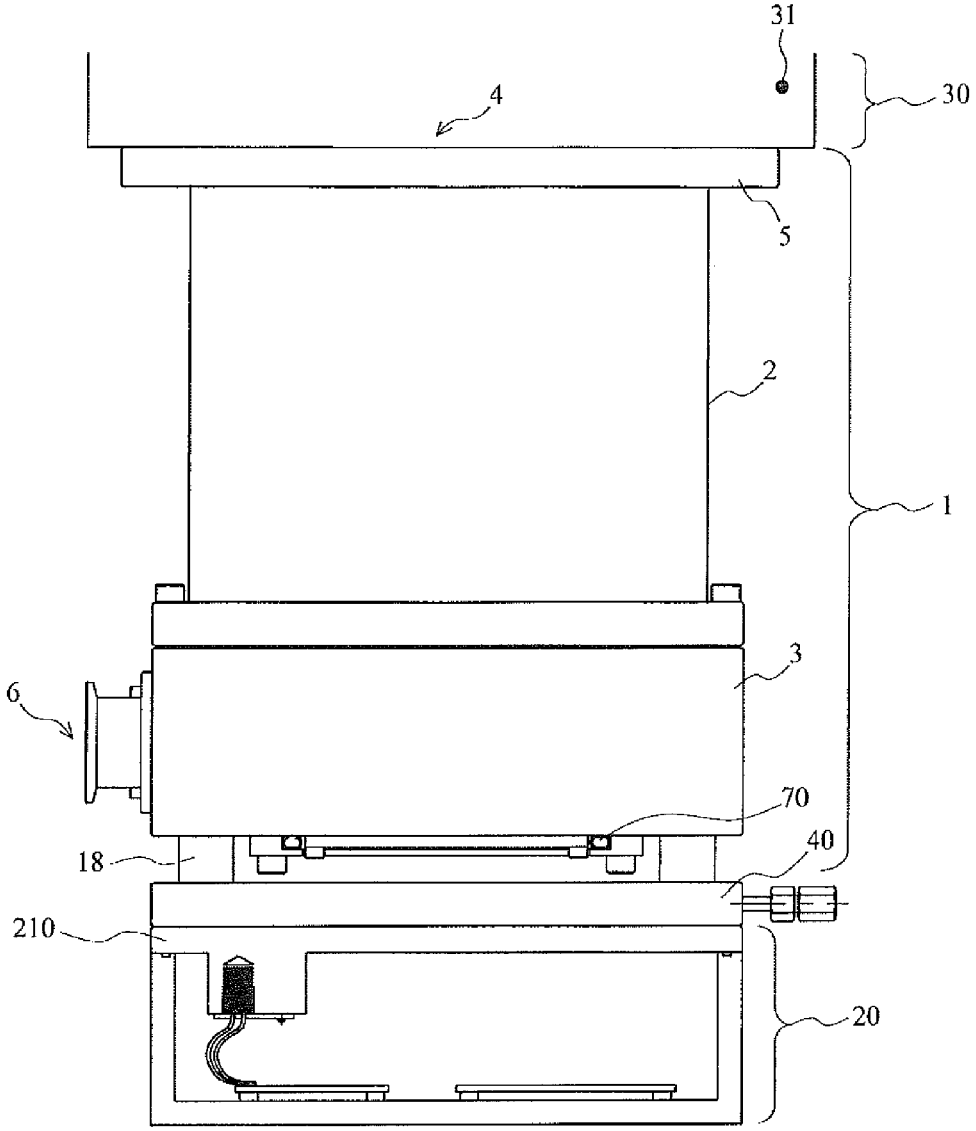
FIG. 1 is a diagram showing an example of a schematic configuration of a turbo-molecular pump main body that is integrated with a vacuum pump control device having a heat dissipation improving casing of a regenerative resistor according to an embodiment of the present invention.

FIG. 1 is a diagram showing an example of a schematic configuration of the turbo-molecular pump main body 1 that is integrated with the vacuum pump control device having the casing for accommodating the regenerative resistor (referred to as "regenerative resistor casing," hereinafter) according to the embodiment of the present invention.

FIG. 1 also shows a cooling plate (a water-cooling plate) 40 connected to the vacuum pump control device 20 and a part of a vacuum chamber 30 connected to the turbomolecular pump main body 1. The water-cooling pump 40 is described later. The vacuum chamber 30 connected to the turbo-molecular pump main body 1 is now described. The vacuum chamber 30 forms a vacuum device that is used as, for example, a chamber of a sur face analysis device or a microfabricated device. The vacuum chamber 30 is vacuum container configured by a vacuum chamber wall 31 and has a connection port in order to be connected to the turbomolecular pump main body 1.

A configuration of the turbo-molecular pump main body 1 is described hereinafter.

Figure 2:
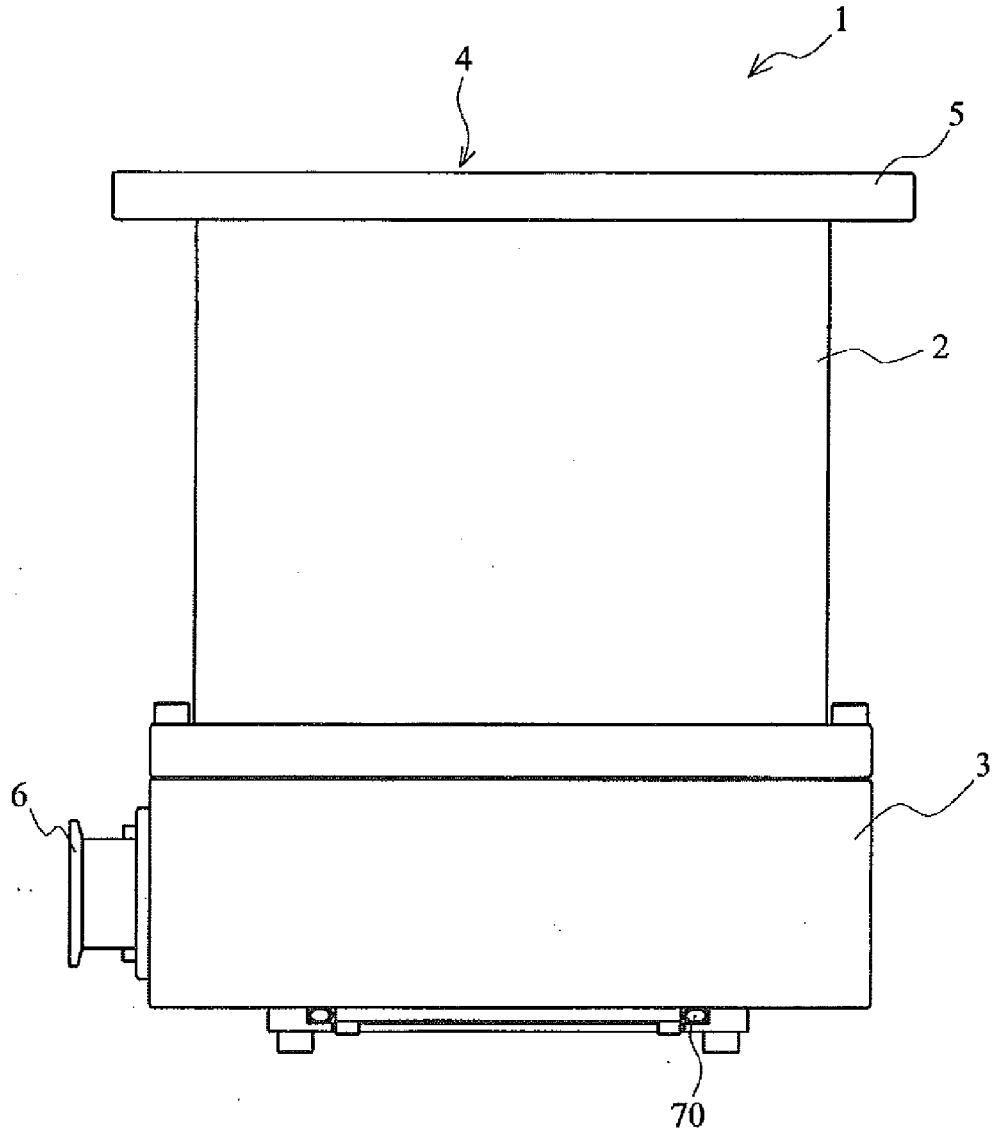
FIG. 2 is a diagram showing an example of a schematic configuration of a turbo-molecular pump main body according to the embodiment of the present invention.

FIG. 2 is a diagram showing an example of a schematic configuration of the turbo-molecular pump main body 1 according to the embodiment of the present invention.

Figure 3:
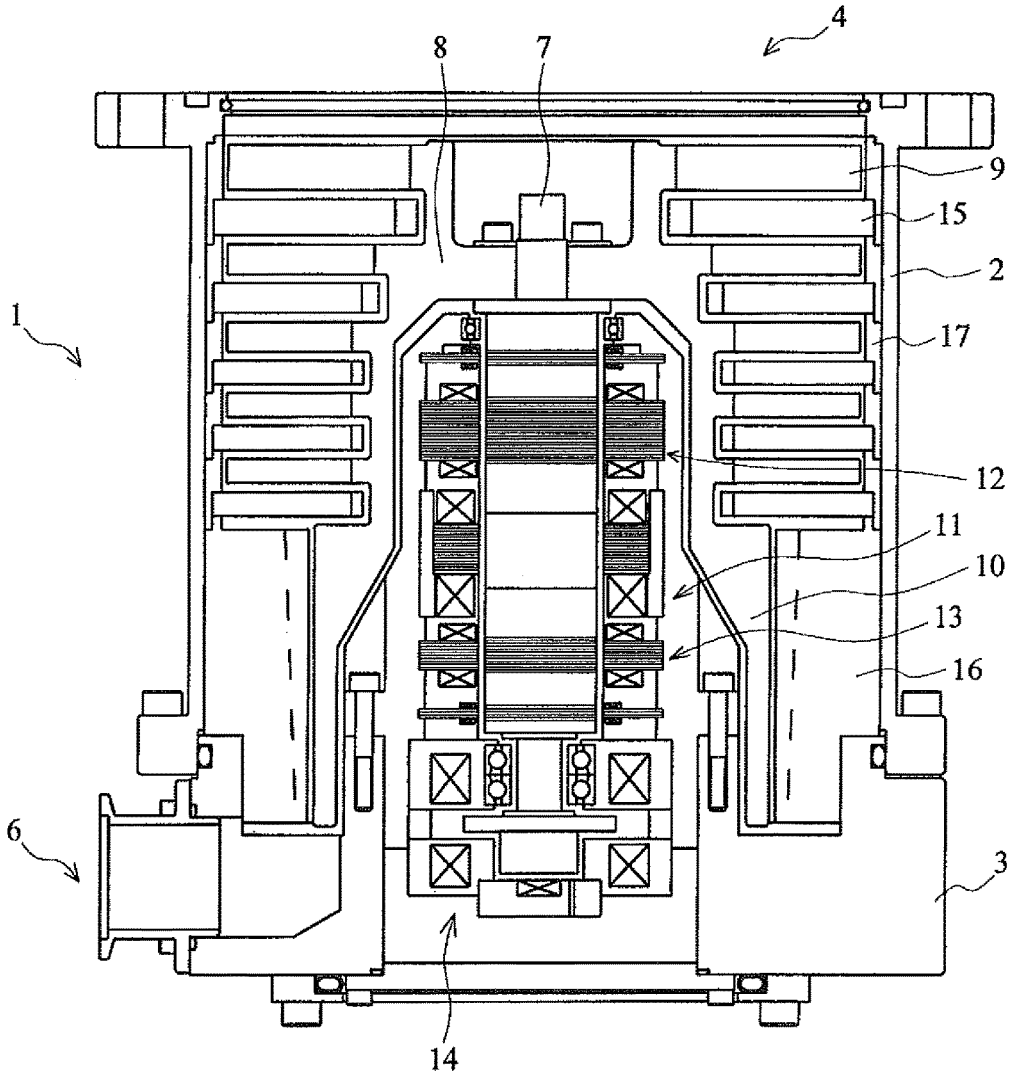
FIG. 3 is a cross-sectional diagram of the turbomolecular pump main body according to the embodiment of the present invention, taken along an axis direction.

FIG. 3 is a cross-sectional diagram of the turbomolecular pump main body 1, taken along an axis direction. The turbo-molecular pump main body 1 is a vacuum pump main body for performing an exhaust process in the vacuum chamber 30. The turbo-molecular pump main body 1 is a so-called composite wing-type molecular pump with a turbo-molecular pump portion and thread groove pump portion. A casing 2 forming an exterior structure of the turbomolecular pump main body 1 is in the shape of substantially a cylinder and configures the housing of the turbomolecular pump main body 1 along with a base 3 provided in a lower part (on the outlet port 6 side) of the casing 2. A gas transfer mechanism, which is a structure bringing out an exhaust function of the turbo-molecular pump main body 1, is accommodated in the housing of the turbo-molecular pump main body 1.

The gas transfer mechanism is configured mainly by a rotating portion supported pivotally so as to be able to rotate, and a fixed portion that is fixed to the housing of the turbo-molecular pump main body 1.

An inlet port 4 for introducing a gas to the turbomolecular pump main body 1 is formed at an end portion of the casing 2. A flange portion 5 projecting toward an outer circumference is formed on an end surface on the inlet port 4 side of the casing 2. The turbomolecular pump main body 1 and the vacuum chamber wall 31 are fixed and bonded to each other with the flange portion 5 therebetween, by using a bolt or other tightening member. The outlet port 6 for discharging the gas from the turbo-molecular pump main body 1 is formed on the base 3. Further, a cooling (water-cooling) pipe 70 formed from a tubular member is embedded in the base 3 in order to reduce the impact of the heat received by the vacuum pump control device 20 from the turbo-molecular pump main body 1. The cooling pipe 70 is a member for cooling the periphery thereof by letting a coolant, which is a heating medium, flow inside the cooling pipe 70 and absorbing heat by means of the coolant. The base 3 is forcibly cooled by the coolant flowing in the cooling pipe 70. As a result, the heat carried from the turbo-molecular pump main body 1 to the vacuum pump control device 20 can be reduced (suppressed) The cooling pipe 70 is configured by a member having low thermal resistance, which is a member having high thermal conductivity, such as copper and stainless steel.

The coolant flowing in the cooling pipe 70, which is a material for cooling an object, may be liquid or a gas. Examples of a liquid coolant include water, calcium chloride solution, and ethylene glycol solution. Examples of a gaseous coolant, on the other hand, include ammonia, methane, ethane, halogen, helium, carbon dioxide, and air. Note that, in the present embodiment, the cooling pipe 70 is disposed on the base 3, but the position for placing the cooling pipe 70 is not limited thereto. For instance, the cooling pipe 70 may be fitted directly into a stator column 10 of the turbo-molecular pump main body 1.

The rotating portion is configured by a shaft 7, which is a rotary shaft, a rotor 8 disposed in the shaft 7, rotor blades 9 provided in the rotor 8, the stator column 10 provided on the outlet port 6 side (the thread groove pump portion), and the like. Note that the shaft 7 and the rotor 8 configure a rotor portion. The rotor blades 9 are inclined at a predetermined angle from a plane perpendicular to the axis of the shaft 7 and expand radially from the shaft 7. The stator column 10 is a cylindrical member disposed concentrically with a rotary axis of the rotor 8.

A motor portion 11 for rotating the shaft 7 at high speed is provided near the middle of an axis direction of the shaft 7. Moreover, radial magnetic bearing devices 12, 13 for pivotally supporting the shaft 7 in a non-contact state in a radial direction are provided on the inlet port 4 side and the outlet port 6 side, respectively, with respect to the motor portion 11 of the shaft 7. Furthermore, an axial magnetic bearing device 14 for pivotally supporting the shaft 7 in a non-contact state in the axis direction (axial direction) is provided at a lower end of the shaft 7.

A fixing portion is formed on the inner circumferential side of the housing of the turbo-molecular pump main body 1. This fixing portion is configured by fixed wings 15 provided on the inlet port side 4 (the turbo-molecular pump portion) and a thread groove spacer 16 provided on an inner circumferential surface of the casing 2.

Each of the fixed wings 15 is configured by a blade that is inclined at a predetermined angle from a plane perpendicular to the axis of the shaft 7 and extends from an inner circumferential surface of the housing of the turbo-molecular pump main body 1 toward the shaft 7. The fixed wings 15 on the respective steps are placed apart from each other by cylindrical spacers 17. The turbo-molecular pump main body 1 has a plurality of steps of the fixed wings 15 arranged alternately with the rotor blades 9 in the axis direction.

A spiral groove is formed on a surface of the thread groove spacer 16 that faces the stator column 10. The thread groove spacer 16 is disposed to face an outer circumferential surface of the stator column 10, with a predetermined amount of clearance (gap) therebetween. A direction of the spiral groove formed in the thread groove spacer 16 is directed toward the outlet port 6 when the gas is transported within the spiral groove in a direction of rotation of the rotor 8. The spiral groove is formed so as to become shallower toward the outlet port 6. Thus, the gas transported within the spiral groove is compressed gradually as it approaches the outlet port 6. The turbo-molecular pump main body 1 having the configuration described above performs an evacuation process in the vacuum chamber 30.

Figure 4A:
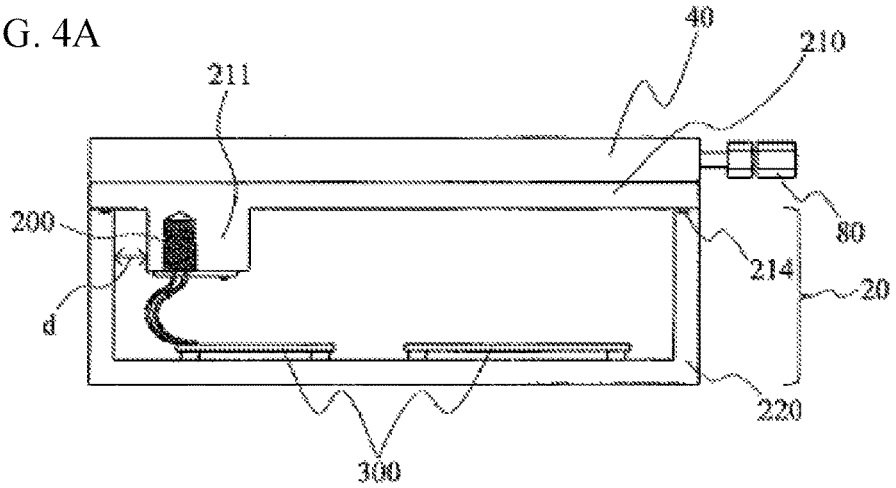
FIGS. 4A-4C are diagrams showing examples of a schematic configuration of a vacuum pump control device according to the embodiment of the present invention.

(Vacuum pump control device) A structure of the vacuum pump control device 20 that is attached to the turbo-molecular pump main body 1 having the above-described configuration is now described. FIG. 4A is a diagram showing an example of a schematic configuration of the vacuum pump control device 20 according to the embodiment of the present invention. The vacuum pump control device 20 according to the present embodiment configures a control unit that has a control circuit for controlling various operations of the turbo-molecular pump main body 1, and is disposed (attached) in a bottom portion of the base 3 of the turbomolecular pump main body 1 as shown in FIG. 1.

The vacuum pump control device 20 of the present embodiment is provided with a connector (not shown) that forms a pair with a connector (not shown) provided in the turbo-molecular pump main body 1. The control circuit provided in the vacuum pump control device 20 is configured to be electrically connected to electronic components of the turbo-molecular pump main body 1 by joining (bonding) the connector of the turbo-molecular pump main body 1 and the connector of the vacuum pump control device 20 to each other. Accordingly, the vacuum pump control device 20 can not only supply drive signals or power of the motor portion 11, the radial magnetic bearing devices 12, 13, the axial magnetic bearing device 14, and a displacement sensor (not shown} of the turbo-molecular pump main body 1 to the turbo-molecular pump main body 1, but also receive various signals from the turbo-molecular pump main body 1, without using a dedicated cable for connecting the turbo-molecular pump main body 1 and the vacuum pump control device 20 to each other.

The vacuum pump control device 20 according to the embodiment of the present invention has a vacuum pump 18 control device housing 220, an upper lid, that is, a control unit casing 210, a regenerative resistor casing 211, a regenerative resistor 200, and a control board 300. The vacuum pump control device housing 220 and the control unit casing 210 are produced by aluminum die casting. The whole or part of the control unit casing 210 functions as the regenerative resistor casing 211. The housing 220, the control unit casing 210, and the regenerative resistor casing 211 are configured by aluminum die casting.

The control unit casing 210 is joined to the housing 220 by a seal member 214 to seal an opening of end of an upper part of the housing 220 (on the turbo-molecular pump main body 1 side) The control board 300 has a control circuit mounted thereon. In the present embodiment, a plurality of the control boards 300 are fixed on the inside of the housing 220.

The control circuits mounted on the control boards 300 are now described.

Each of the control circuits is provided with a drive circuit, a power supply circuit and the like for the motor portion 11, the radial magnetic bearing devices 12, 13, and the axial magnetic bearing device 14. In addition, a circuit for controlling these drive circuits and a storage element for storing various types of information used for controlling the turbo-molecular pump main body 1, are mounted on each control circuit.

Generally, an electronic component (element) used in an electronic circuit has a set environmental temperature in consideration of reliability. For instance, the environmental temperature of the storage element described above is set at approximately 60° C. Note that such an element of low heat-resisting property is expressed as "low heat resistant element."

During the operation of the turbo-molecular pump main body 1, each of the electronic components must be used within a set environmental temperature range.

The circuits provided in the vacuum pump control device 20 use, not only the low heat resistant element described above, but also a large number of components (power elements) that generate heat due to loss inside each element (internal loss). For example, transistor elements that configure an inverter circuit, which is the drive circuit of the motor portion 11, correspond to these elements.

Such elements having a large amount of heat generated themselves also have set environmental temperatures.

(Cooling Mechanism of the Regenerative Resistor)

The water-cooling plate 40 is connected to the vacuum pump control device 20, as shown in FIG. 4A.

In the water-cooling plate 40, a water-cooling pipe 80, which is the same as the cooling pipe 70 of the vacuum pump main body described above (turbo-molecular pump main body 1), is embedded in the form of a circumference. The water-cooling plate 40 is cooled by a coolant flowing in the cooling pipe 80, and, consequently, the control unit casing 210 that is in contact with the water-cooling plate 40 and the regenerative resistor casing 211 that is a part of the control casing 210, are forcibly cooled. Furthermore, the water-cooling plate 40 is fixed to a formation surface of a side wall of the housing 220 by a tightening member such as a bolt (not shown). In the present embodiment, the water-cooling plate 40 is configured detachably, i.e., so as to be able to be easily separated from the vacuum pump control device 20 by removing the bolt (not shown).

(The Regenerative Resistor Casing of the Vacuum Pump Control Device)

In the present embodiment, the regenerative resistor casing 211 is disposed in a position away from a side surface of the vacuum pump control device 20 (a side portion of the housing 220) by a clearance d, as shown in FIG. 4A. The clearance d is, for example, approximately 5 mm to 20 m.

Instead of attaching the regenerative resistor 200 to the inside of the side surface of the vacuum pump control device 20 (the side portion of the housing 220), the regenerative resistor 200 is positioned away from the side portion of the housing 220, as described above. Therefore, the section that is likely to be contacted by a worker performing operations/checkups (the side portion of the hosing 220) can be prevented from becoming excessively hot, improving the safety of the operations.

The present embodiment has the configuration in which the clearance d is provided between the regenerative resistor casing 211 and the vacuum pump control device 20. However, the present embodiment is not limited thereto.

Figure 4B:
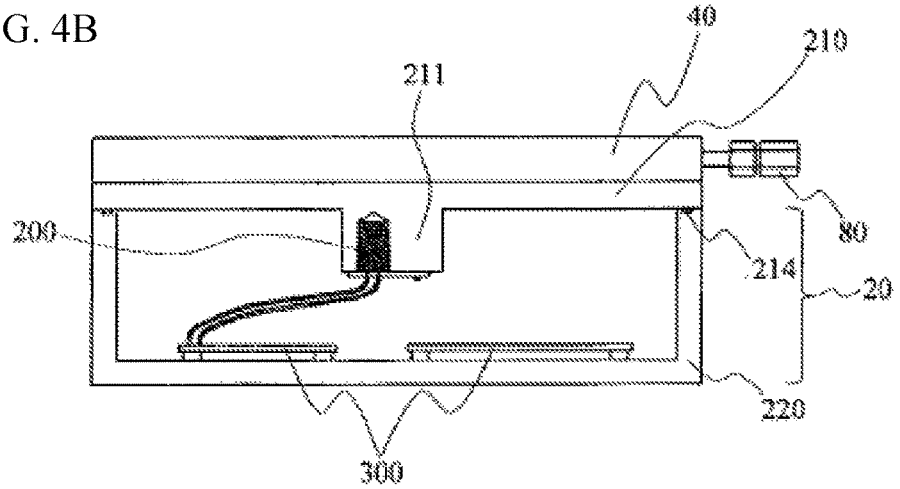

For example, the regenerative resistor casing 211 can be placed in the center of the control unit casing 210, as shown in FIG. 4B.

Figure 4C:
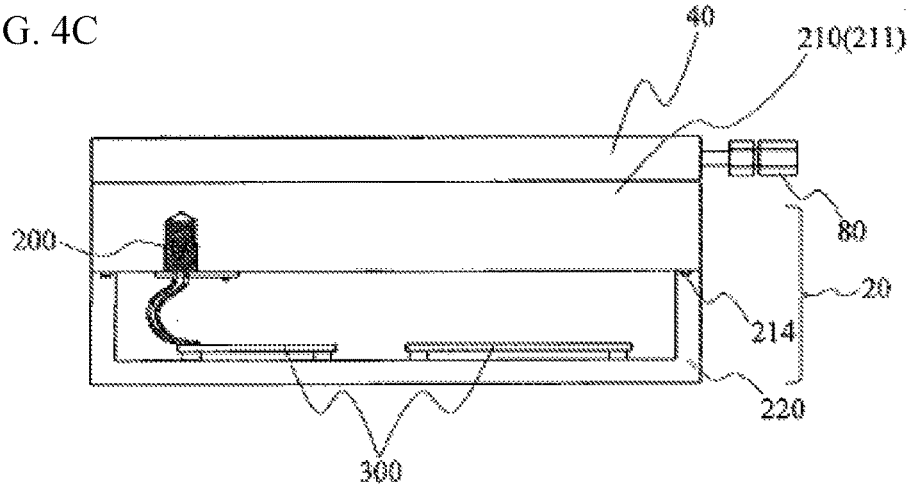

The regenerative resistor casing 211 can also be configured by the control unit casing 210 itself, as shown in FIG. 4C.

Due to the configuration described above in which the regenerative resistor 200 is stored in the aluminum die-cast casing (the regenerative resistor casing 211) larger than the regenerative resistor 200, the heat capacity increases more than when the regenerative resistor 200 is disposed alone. Therefore, an increase in temperature of the regenerative resistor 200 itself can be prevented.

If the regenerative resistor 200 generates heat when it is disposed alone, there is a risk that the temperature of the regenerative resistor 200 increases to 200 to 300° C., exceeding an allowable temperature (which is generally set at approximately 300° C.) thereof. However, storing the regenerative resistor 200 in the container (aluminum die-cast casing) can make it difficult for the temperature of the regenerative resistor 200 to increase for the reasons mentioned above. The experiment has succeeded in lowering the temperature to approximately 150° C., which is not an issue for the allowable temperature.

Figure 5A:
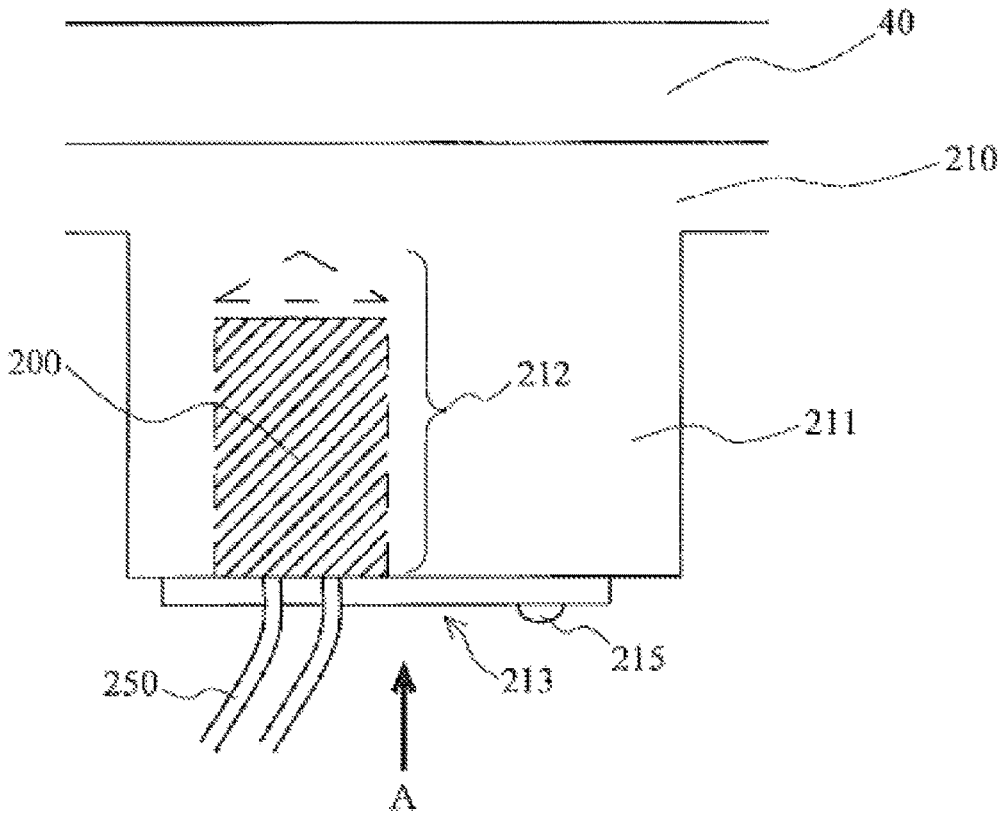
FIG. 5A is an enlargement of schematic configurations of a control unit casing and regenerative resistor casing according to the embodiment of the present invention.
Figure 5B:
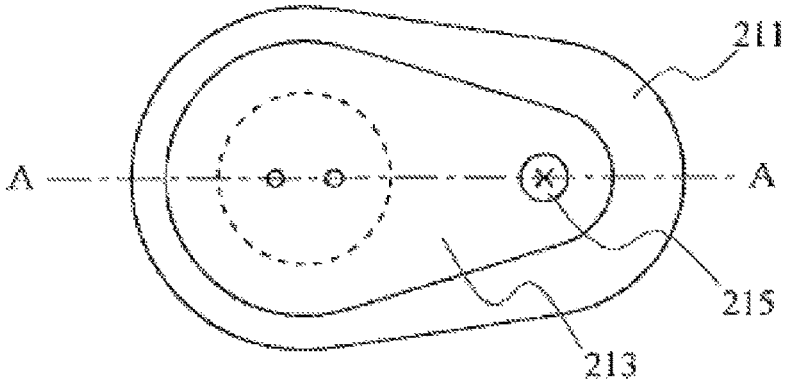
FIG. 5B is an arrow view taken along the arrow A of FIG. 5A.

FIG. 5A is an enlargement of schematic configurations of the control unit casing 210 and regenerative resistor casing 211 according to the embodiment of the present invention. FIG. 5B is an arrow view taken along the arrow A of FIG. 5A.

The regenerative resistor casing 211 according to the embodiment of the present invention is configured as a part of the control unit casing 210 (aluminum die-cast casing) that plays the role of the upper lid (top panel) of the vacuum pump control device 20.

In the present embodiment, the regenerative resistor casing 211 is a part of the control unit casing 210; however, the present embodiment is not limited to this configuration. For example, the regenerative resistor casing 211 produced separately by aluminum die casting (metal mold casting) can be attached to the control unit casing 210 by an attachment tool (e.g., a bolt, etc.).

The regenerative resistor casing 211 has a hollow portion 212 of a size accommodating the entire regenerative resistor 200. The regenerative resistor 200 is inserted and fitted into this hollow portion 212. The regenerative resistor casing 211 further has a regenerative resistor fixture 213 that functions as a lid for closing (sealing) the hollow portion 212 to prevent the fitted regenerative resistor 200 from falling, and a bolt 215 that is an attachment tool for attaching the regenerative resistor fixture 213 to the regenerative resistor casing 211 after the regenerative resistor 200 is fitted in the regenerative resistor casing 211. With these components provided in the regenerative resistor casing 211, the regenerative resistor 200 can removably be supported fixedly (stored).

The regenerative resistor 200 is connected to the control board 300 (FIGS. 4A-4C) by a conductor wire 250.

In order to increase the heat capacity, the regenerative resistor casing 211 of the present embodiment is in the shape of a cylinder (column) with a rectangular cross-sectional shape and an oval bottom shape (a barrel shape, an egg shape) (when viewed in the direction of the arrow A), as shown in FIGS. 5A and 5B. However, the shape of the regenerative resistor casing 211 is not limited thereto. In order to be able to insert the regenerative resistor 200, the lateral area of an inner surface of the hollow portion 212 of the regenerative resistor casing 211 is made greater than that of an outer surface (outer circumference) of the regenerative resistor 200.

More specifically, a clearance is provided to accommodate the regenerative resistor 200 that expands when the regenerative resistor 200 generates heat. This clearance is a space of approximately 12 to 38 μm.

With the appropriate size of clearance provided in advance, the regenerative resistor 200, which expands when the regenerative resistor 200 generates heat, can be supported fixedly (stored) in the regenerative resistor casing 211, tightly with no space therebetween (in an adhered state).

Although the hollow portion 212 and the regenerative resistor 200 to be inserted therein are slightly separated from each other at the time of the insertion of the regenerative resistor 200, the space (clearance) between regenerative resistor 200 and the regenerative resistor casing 211 becomes eliminated as the regenerative resistor 200 generates heat and expands when the vacuum pump control device 20 is driven (i.e., when the regenerative resistor 200 needs to be cooled). Thus, the regenerative resistor 200 can be kept in a contact state with the regenerative resistor casing 211 at all times. Therefore, the regenerative resistor 200 can constantly be cooled efficiently by the water-cooling plate 40 (FIGS. 4A-4C) disposed in the upper part of the regenerative resistor casing 211 (i.e., on the turbo-molecular pump main body 1 side).

In the present embodiment, because the regenerative resistor 200 and the regenerative resistor casing 211 are in close contact with each other as described above, the water-cooling plate 40 can directly cool the regenerative resistor 200 via the regenerative resistor casing 211 (in other words, there is no air therebetween).

Figure 8A:
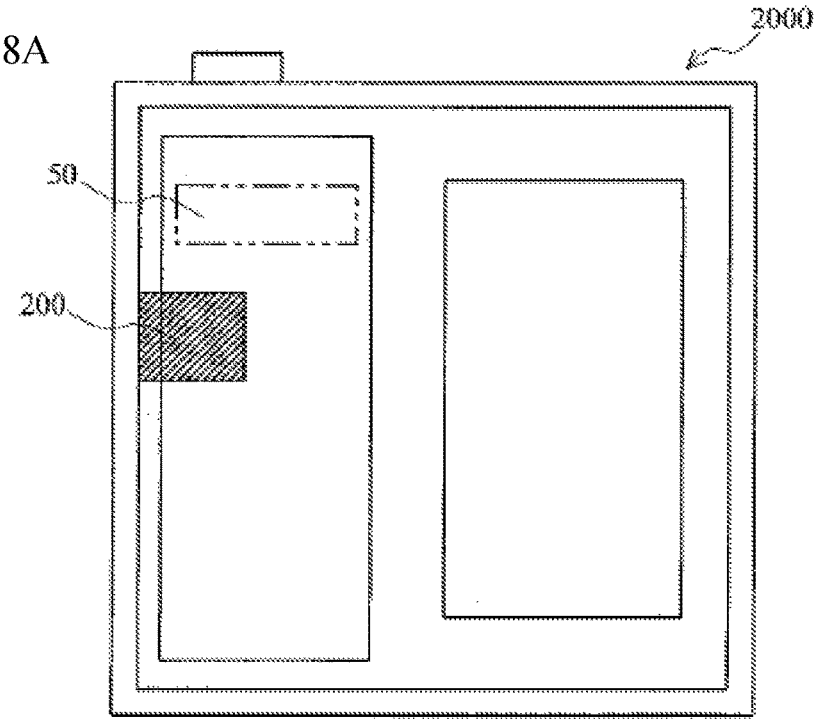
FIGS. 8A-8C are diagrams showing an example of a schematic configuration of a conventional vacuum pump control device.
Figure 8B:
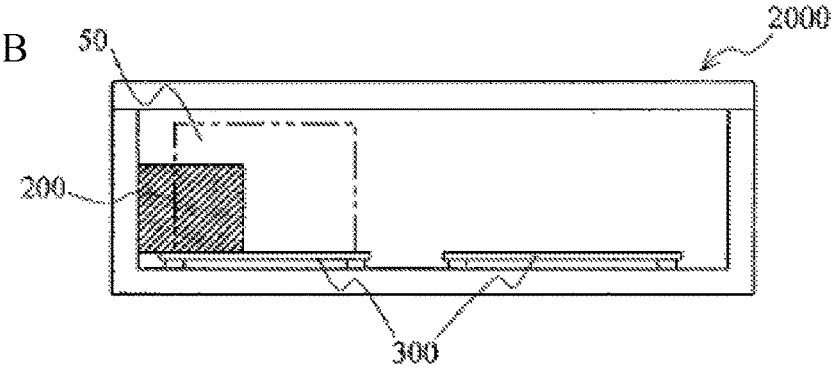
Figure 8C:
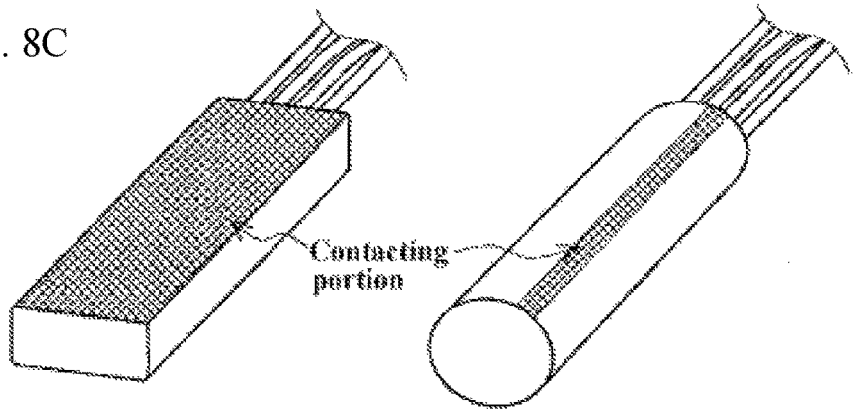

Moreover, according to the present embodiment having such a configuration, the area of contact between the regenerative resistor 200 and the regenerative resistor casing 211 (the area where the regenerative resistor 200 and the regenerative resistor casing 211 are brought into close contact with each other) is significantly greater that of the conventional configuration (FIG. 8C) in which the regenerative resistor 200 and the side portion of the housing 220 to which the regenerative resistor 200 is attached are in line contact with each other (when the regenerative resistor is in the shape of a cylinder) or in surface contact (one surface) (when the regenerative resistor is in a rectangular shape).

Therefore, the cooling effect of the water-cooling plate 40 can be exercised extensively over a side circumferential surface of the regenerative resistor 200. As a result, the cooling effect can be improved.

The turbo-molecular pump main body 1 and the vacuum pump control device 20 are integrated with each other in the present embodiment; however, the present embodiment is not limited to this configuration.

Figure 9:
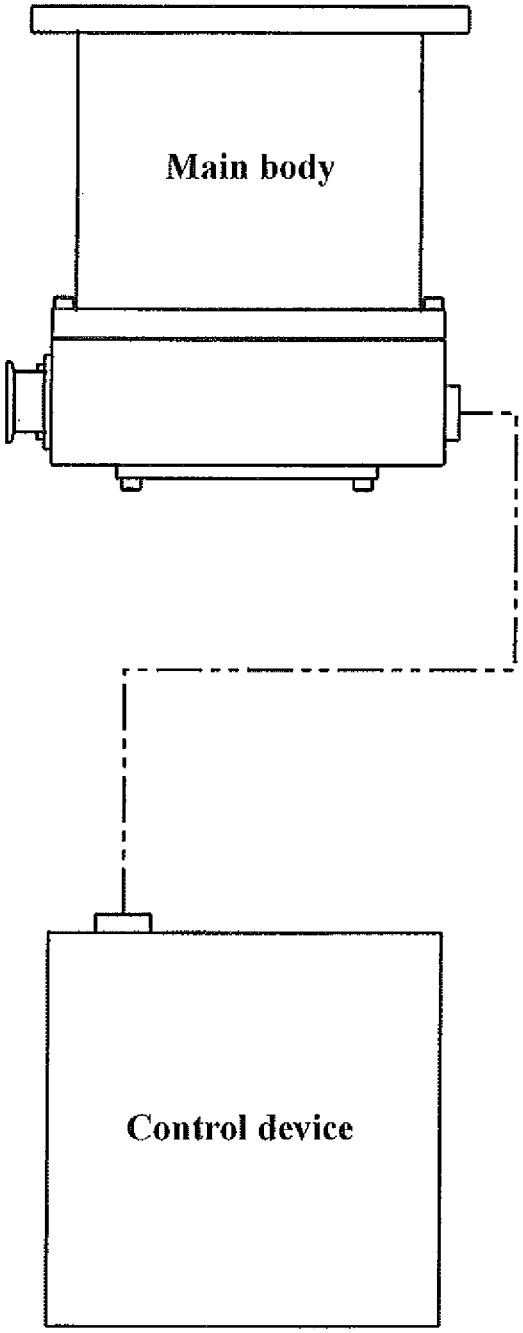
FIG. 9 is a diagram showing an example of a connection between a vacuum pump main body and a vacuum pump control device.

For example, when the vacuum pump main body (turbomolecular pump main body) and the vacuum pump control device are not integrated with each other as shown in FIG. 9, the vacuum pump main body and the vacuum pump control device may be connected with each other by a cable and then disposed. In this case, a cooling system (a water-cooling pipe, etc.) for use in a cooling plate used in the vacuum pump control device may be provided separately, and water required for cooling may be prepared (supplied) thereto.

(The Regenerative Resistor)

Figure 6A:
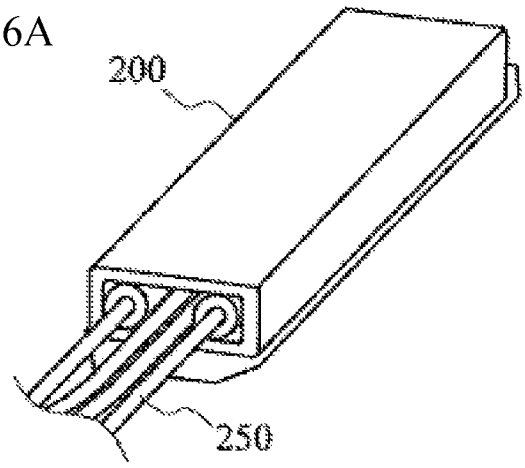
FIGS. 6A-6C are diagrams for explaining the regenerative resistor according to the embodiment of the present invention.
Figure 6B:
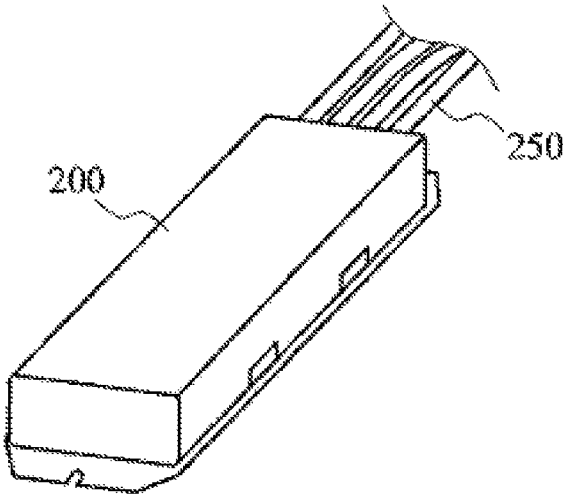
Figure 6C:
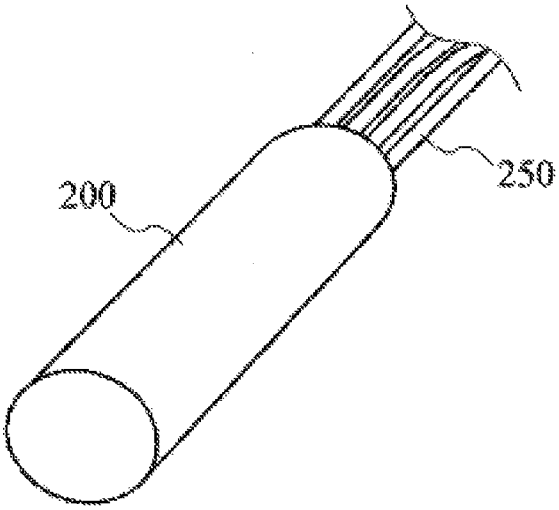

FIGS. 6A to 6C are diagrams for explaining the regenerative resistor.

The regenerative resistor 200 is in various shapes. In the present embodiment, the regenerative resistor 200 is in the shape of a cylinder or column (cylindrical rod); however, the shape of the regenerative resistor 200 is not limited thereto. For example, a columnar shape with a square, hexagonal, or rectangular bottom shape can be considered as the shape of the regenerative resistor.

Modification

The embodiment of the present invention described above can be modified in various forms.

Figure 7:
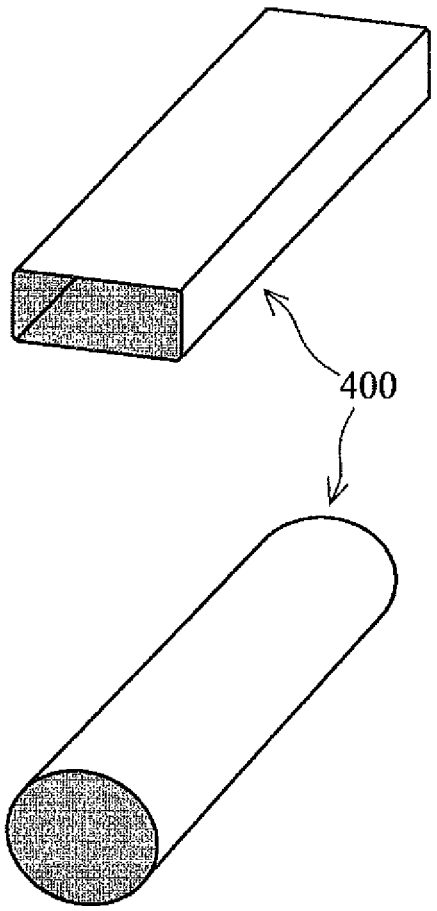
FIG. 7 is a diagram showing an example of a metal case for placing the regenerative resistor therein, the metal case being used when inserting the regenerative resistor into a regenerative resistor casing according to a modification of the embodiment of the present invention.

FIG. 7 is a diagram showing an example of a metal case 400, which is a regenerative resistor storing tool for storing the regenerative resistor 200 and used when inserting the regenerative resistor 200 into the regenerative resistor casing 211 according to a modification of the embodiment of the present invention.

The shape or size of a ready-made regenerative resistor 200 is normally various and inconsistent, as shown in FIGS. 6A to 6C. The surface of such a regenerative resistor 200 is not a smooth flat surface. For this reason, when directly inserting the regenerative resistor 200 into the regenerative resistor casing 211, only a certain part of the regenerative resistor 200 comes into contact with an inner wall surface of the regenerative resistor casing 211.

The present modification deals with such various shapes/sizes and non-smooth surface of the regenerative resistor 200, by placing the regenerative resistor 200 in the metal case 400 for exclusive use for a regenerative resistor, instead of directly inserting the regenerative resistor 200 into the regenerative resistor casing 211, and then inserting (storing) this metal case 400 into the regenerative resistor casing 211. The cooling effect is further enhanced by pouring electrothermal grease of high thermal conductivity around the regenerative resistor 200 in the metal case 400 to narrow the space therebetween. As the metal case for exclusive use for a regenerative resistor, a rectangular metal case 400 is used when the regenerative resistor 200 is in a rectangular shape as shown in FIGS. 6A and 6B, or a cylindrical metal case 400 is used when the regenerative resistor 200 is in a cylindrical shape as shown in FIG. 6C.

This metal case 400 is shaped such that an outer circumference thereof extends along the inner circumferential surface of the regenerative resistor casing (i.e., the hollow portion). Therefore, the metal case 400 can be fitted in the regenerative resistor casing 211, with no space therebetween.

The configuration in which the regenerative resistor 200 in the metal case 400 of high form/dimensional accuracy is inserted into the regenerative resistor casing 211, can reduce the form error between the regenerative resistor casing 211 and the metal case 400 and equalize the dimensional difference therebetween.

Provision of the metal case 400 makes it possible for the regenerative resistor 200 to come into close contact with the inside of the metal case 400 when generating heat and thereby expanding. As a result, the regenerative resistor 200 can come into close contact with the regenerative resistor casing 211 (via the metal case 400) that is in close contact with the outside of the metal case 400.

It is desired that the metal case 400 be made of heat-resistant steel or stainless steel (SUS) that give thermal resistance.

This is because, if the metal case 400 is prepared with aluminum, which is the same material as the regenerative resistor casing 211 that is an aluminum diecast casing, the heat of the regenerative resistor 200 might causes fusion between the metal case 400 and the regenerative resistor casing 211.

Fusion therebetween makes it difficult or impossible to remove the regenerative resistor 200 from the regenerative resistor casing 211 when, for example, replacing the regenerative resistor 200.

In the configuration in which the metal case 400 conforming to the shape of the regenerative resistor 200 is used, even if the expanded regenerative resistor 200 cannot come into close contact with the regenerative resistor casing 211, the interior of the metal case 400 can be machined in accordance with the regenerative resistor 200 (i.e., such that the expanded regenerative resistor 200 can come into close contact with the metal case 400), so that the regenerative resistor casing 211 does not have to be machined. As a result, the production costs can be reduced.

In a modification of the regenerative resistor 200, a regenerative resistor may be made to order, by installing a resistor in the metal case 400 and then encasing the resistor in ceramic or alumina oxide.

According to the embodiment and modification of the present invention described above, (1) to (5) described hereinafter can be realized.

(1) The whole or part of the top panel of the vacuum pump control device is provided with the aluminum die-cast regenerative resistor casing for exclusive use for a regenerative resistor. Therefore, a higher heat capacity can be obtained compared to when the regenerative resistor is disposed alone, making it difficult for the temperature of the regenerative resistor itself to increase.

In other words, the regenerative resistor does not generate heat to high temperature by itself. Instead, the heat of the regenerative resistor is transmitted to the regenerative resistor casing that plays the role of accumulating heat. Accordingly, the heat capacity can be increased more than when the regenerative resistor is disposed alone.

As a result, a vacuum pump control device capable of inhibiting the temperature increase and a vacuum pump having such a vacuum pump control device can be provided.

(2) The cooling (water-cooling) plate is provided on the top panel (i.e., the control unit casing) of the vacuum pump control device having the regenerative resistor casing. Therefore, the heat radiated from the regenerative resistor can be blocked near the top panel of the vacuum pump control device. This can not only reduce (attenuate) the temperature increases in the vacuum pump control device main body but also reduce the amount of heat that is radiated from the regenerative resistor to the inside of the turbomolecular pump integrated with the vacuum pump control device.

As a result, a vacuum pump control device capable of improving heat dissipation of a regenerative resistor thereof by using a simple configuration and capable of appropriately preventing a temperature increase, and a vacuum pump having this vacuum pump control device, can be provided.

(3) A hole (hollow) for accommodating the entire regenerative resistor is provided in the regenerative resistor casing. The hole is designed to conform to the shape of the regenerative resistor, in other words, designed to have a size that allows the regenerative resistor and the regenerative resistor casing to come into close contact with each other when the regenerative resistor generates heat and expands. Moreover, the regenerative resistor is inserted into this hole, thereby closing the opening of the hole. This configuration can enhance the adherence between the regenerative resistor casing and the regenerative resistor, improving the thermal conductivity.

As a result, a vacuum pump control device capable of improving heat dissipation of a regenerative resistor thereof, and a vacuum pump having this vacuum pump control device, can be provided.

(4) The regenerative resistor casing is installed in a position away from the side wall of the housing of the vacuum pump control device by a predetermined amount of clearance, in the vacuum pup control device. Therefore, a temperature increase of the wall surface of the vacuum pump control device can appropriately be suppressed, improving the safety when a person touches the outside of the vacuum pump control device.

(5) The regenerative resistor is placed in the metal case for exclusive use for a regenerative resistor, and then this metal case is inserted into (stored in) the regenerative resistor casing, the metal case conforming to the shape of the inner circumferential surface of the regenerative resistor casing. This configuration, therefore, can bring the regenerative resistor casing and the regenerative resistor into close contact with each other, regardless of the various different shapes/sizes and non-smooth surface of the regenerative resistor main body.

As a result, even when using regenerative resistors of different types, metal cases corresponding to the types can be used. Therefore, a vacuum pump control device capable of uniformly improving heat dissipation of the corresponding regenerative resistor, and a vacuum pump having this vacuum pump control device, can be provided.

EXPLANATION OF REFERENCE NUMERALS

1 Turbo-molecular pump main body; 2 Casing; 3 Base; 4 Inlet port; 5 Flange portion; 6 Outlet port; 7 Shaft; 8 Rotor; 9 Rotor blade; 10 Stator column; 11 Motor portion; 12, 13 Radial magnetic bearing device; 14 Axial magnetic bearing device; 15 Fixed wing; 16 Thread groove spacer; 17 Spacer; 18 Pump fixing leg; 20 Vacuum pump control device; 30 vacuum chamber; 31 Vacuum chamber wall; 40 Water-cooling plate; 50 Air-cooling fan; 70 Cooling pipe; 80 Cooling pipe; 200 Regenerative resistor; 210 Control unit casing; 211 Regenerative resistor casing; 212 Hollow portion; 213 Regenerative resistor fixture; 214 Seal member; 215 Fixing bolt; 220 Housing; 250 Conductor wire; 300 Control board; 400 Metal case; 2000 vacuum pump control device

What is claimed is:

1. A vacuum pump control device for controlling a vacuum pump main body, the vacuum pump control device comprising:

a housing in which a control circuit for controlling the vacuum pump main body is disposed;

a regenerative resistor casing contacting or formed together with the housing, wherein the regenerative resistor casing defines a hollow portion into which is inserted a regenerative resistor consuming regenerative energy, and wherein the regenerative resistor casing is configured to accumulate heat generated by the regenerative resistor to reduce temperature increase of the regenerative resistor when the regenerative resistor generates heat;

a regenerative resistor fixture that fixes the regenerative resistor within the hollow portion; and a cooling mechanism for cooling the regenerative resistor casing, wherein the regenerative resistor is sized to contact the regenerative resistor casing when the regenerative energy is consumed by the regenerative resistor, and heat generated by the regenerative resistor is transferred from the regenerative resistor through the regenerative resistor casing to the cooling mechanism.

2. The vacuum pump control device according to claim 1, wherein the regenerative resistor casing is produced by a casting process.

3. The vacuum pump control device according to claim 1, wherein the regenerative resistor casing is positioned away from a side surface sandwiched between a surface of the housing on which the control circuit is disposed and a surface of the housing on which the regenerative resistor casing is provided.

4. The vacuum pump control device according to claim 1, wherein the regenerative resistor is stored in a regenerative resistor storing tool having an outer circumferential surface fitted into an inner circumference of the hollow portion, and is then inserted into the hollow portion.

5. The vacuum pump control device according to claim 4, wherein between the inner circumference of the hollow portion and the regenerative resistor storing tool inserted thereto, a clearance is provided in advance for accommodating the regenerative resistor that expands when the regenerative resistor generates heat.

6. The vacuum pump control device according to claim 2, wherein the regenerative resistor casing is positioned away from a side surface sandwiched between a surface of the housing on which the control circuit is disposed and a surface of the housing on which the regenerative resistor casing is provided.

7. The vacuum pump control device according to claim 2, wherein the regenerative resistor is stored in a regenerative resistor storing tool having an outer circumferential surface fitted into an inner circumference of the hollow portion, and is then inserted into the hollow portion.

8. The vacuum pump control device according to claim 3, wherein the regenerative resistor is stored in a regenerative resistor storing tool having an outer circumferential surface fitted into an inner circumference of the hollow portion, and is then inserted into the hollow portion.

9. The vacuum pump control device according to claim 7, wherein the regenerative resistor is stored in a regenerative resistor storing tool having an outer circumferential surface fitted into an inner circumference of the hollow portion, and is then inserted into the hollow portion.

10. The vacuum pump control device according to claim 8, wherein between the inner circumference of the hollow portion and the regenerative resistor storing tool inserted thereto, a clearance is provided in advance for accommodating the regenerative resistor that expands when the regenerative resistor generates heat.

11. The vacuum pump control device according to claim 9, wherein between the inner circumference of the hollow portion and the regenerative resistor storing tool inserted thereto, a clearance is provided in advance for accommodating the regenerative resistor that expands when the regenerative resistor generates heat.

12. The vacuum pump control device according to claim 10, wherein between the inner circumference of the hollow portion and the regenerative resistor storing tool inserted thereto, a clearance is provided in advance for accommodating the regenerative resistor that expands when the regenerative resistor generates heat.

13. The vacuum pump control device according to claim 1, wherein the regenerative resistor fixture closes the hollow portion to substantially enclose the regenerative resistor within the hollow portion of the regenerative resistor casing.

14. A vacuum pump comprising:

a vacuum pump main body including a gas transfer mechanism for transferring a gas from an inlet port to an outlet port; and a vacuum pump control device comprising:

a housing in which a control circuit for controlling the vacuum pump main body is disposed;

a regenerative resistor casing contacting or formed together with the housing, wherein the regenerative resistor casing defines a hollow portion into which is inserted a regenerative resistor consuming regenerative energy, and wherein the regenerative resistor casing is configured to accumulate heat generated by the regenerative resistor to reduce temperature increase of the regenerative resistor when the regenerative resistor generates heat;

a regenerative resistor fixture that fixes the regenerative resistor within the hollow portion; and a cooling mechanism for cooling the regenerative resistor casing, wherein the regenerative resistor is sized to contact the regenerative resistor casing when the regenerative energy is consumed by the regenerative resistor, and heat generated by the regenerative resistor is transferred from the regenerative resistor through the regenerative resistor casing to the cooling mechanism.

15. The vacuum pump according to claim 14, wherein the regenerative resistor casing is produced by a casting process.

16. The vacuum pump according to claim 14, wherein the regenerative resistor casing is positioned away from a side surface sandwiched between a surface of the housing on which the control circuit is disposed and a surface of the housing on which the regenerative resistor casing is provided.

17. The vacuum pump according to claim 14, wherein the regenerative resistor is stored in a regenerative resistor storing tool having an outer circumferential surface fitted into an inner circumference of the hollow portion, and is then inserted into the hollow portion.

18. The vacuum pump according to claim 17, wherein between the inner circumference of the hollow portion and the regenerative resistor storing tool inserted thereto, a clearance is provided in advance for accommodating the regenerative resistor that expands when the regenerative resistor generates heat.

19. The vacuum pump according to claim 15, wherein the regenerative resistor casing is positioned away from a side surface sandwiched between a surface of the housing on which the control circuit is disposed and a surface of the housing on which the regenerative resistor casing is provided.

20. The vacuum pump according to claim 15, wherein the regenerative resistor is stored in a regenerative resistor storing tool having an outer circumferential surface fitted into an inner circumference of the hollow portion, and is then inserted into the hollow portion.

21. The vacuum pump according to claim 16, wherein the regenerative resistor is stored in a regenerative resistor storing tool having an outer circumferential surface fitted into an inner circumference of the hollow portion, and is then inserted into the hollow portion.

22. The vacuum pump according to claim 20, wherein the regenerative resistor is stored in a regenerative resistor storing tool having an outer circumferential surface fitted into an inner circumference of the hollow portion, and is then inserted into the hollow portion.

23. The vacuum pump according to claim 21, wherein between the inner circumference of the hollow portion and the regenerative resistor storing tool inserted thereto, a clearance is provided in advance for accommodating the regenerative resistor that expands when the regenerative resistor generates heat.

24. The vacuum pump according to claim 22, wherein between the inner circumference of the hollow portion and the regenerative resistor storing tool inserted thereto, a clearance is provided in advance for accommodating the regenerative resistor that expands when the regenerative resistor generates heat.

25. The vacuum pump according to claim 23, wherein between the inner circumference of the hollow portion and the regenerative resistor storing tool inserted thereto, a clearance is provided in advance for accommodating the regenerative resistor that expands when the regenerative resistor generates heat.

26. The vacuum pump according to claim 14, wherein the regenerative resistor fixture closes the hollow portion to substantially enclose the regenerative resistor within the hollow portion of the regenerative resistor casing.

* * * * *